United States Patent [19]

Focke

[11] Patent Number: 4,603,534

[45] Date of Patent: Aug. 5, 1986

[54] APPARATUS FOR WRAPPING ARTICLES, ESPECIALLY CIGARETTE GROUPS

[75] Inventor: Heinz Focke, Verden, Fed. Rep. of Germany

[73] Assignee: Focke & Co., (GmbH & Co.), Verden, Fed. Rep. of Germany

[21] Appl. No.: 666,516

[22] Filed: Oct. 30, 1984

[30] Foreign Application Priority Data

Nov. 9, 1983 [DE] Fed. Rep. of Germany ..... 3340408

[51] Int. Cl.[4] ..... B65B 19/24

[52] U.S. Cl. ..... 53/231; 53/389; 493/113

[58] Field of Search ..... 53/231, 230, 389, 466; 493/113

[56] References Cited

U.S. PATENT DOCUMENTS

| | | | |
|---|---|---|---|
| 2,153,483 | 4/1939 | Rose | 53/231 |
| 2,860,466 | 11/1958 | Ingram | 53/231 X |
| 3,200,555 | 8/1965 | Liedtke | 53/231 X |
| 3,435,585 | 4/1969 | Coles | 53/230 X |
| 4,351,142 | 9/1982 | Focke et al. | 53/389 X |

*Primary Examiner*—James F. Coan

*Attorney, Agent, or Firm*—Sughrue, Mion, Zinn, Macpeak & Seas

[57] ABSTRACT

For the wrapping of cigarette groups 10 in blanks 13 (tin foil), a sheet of material 28 is fed at a constant conveying speed V1 to a suction and cutting cylinder 32 rotating at a relatively considerably higher speed. On the latter, the blank 13 is severed from the sheet of material 28, the blank being accelerated until it is transferred to suction disks 40, 41, between which the cigarette group 10 is conveyed through, at the same time carrying along the blank 13 which is at a standstill during this phase. For this purpose, the suction disks 40, 41 are driven intermittently.

11 Claims, 6 Drawing Figures

APPARATUS FOR WRAPPING ARTICLES, ESPECIALLY CIGARETTE GROUPS

Figure 1:
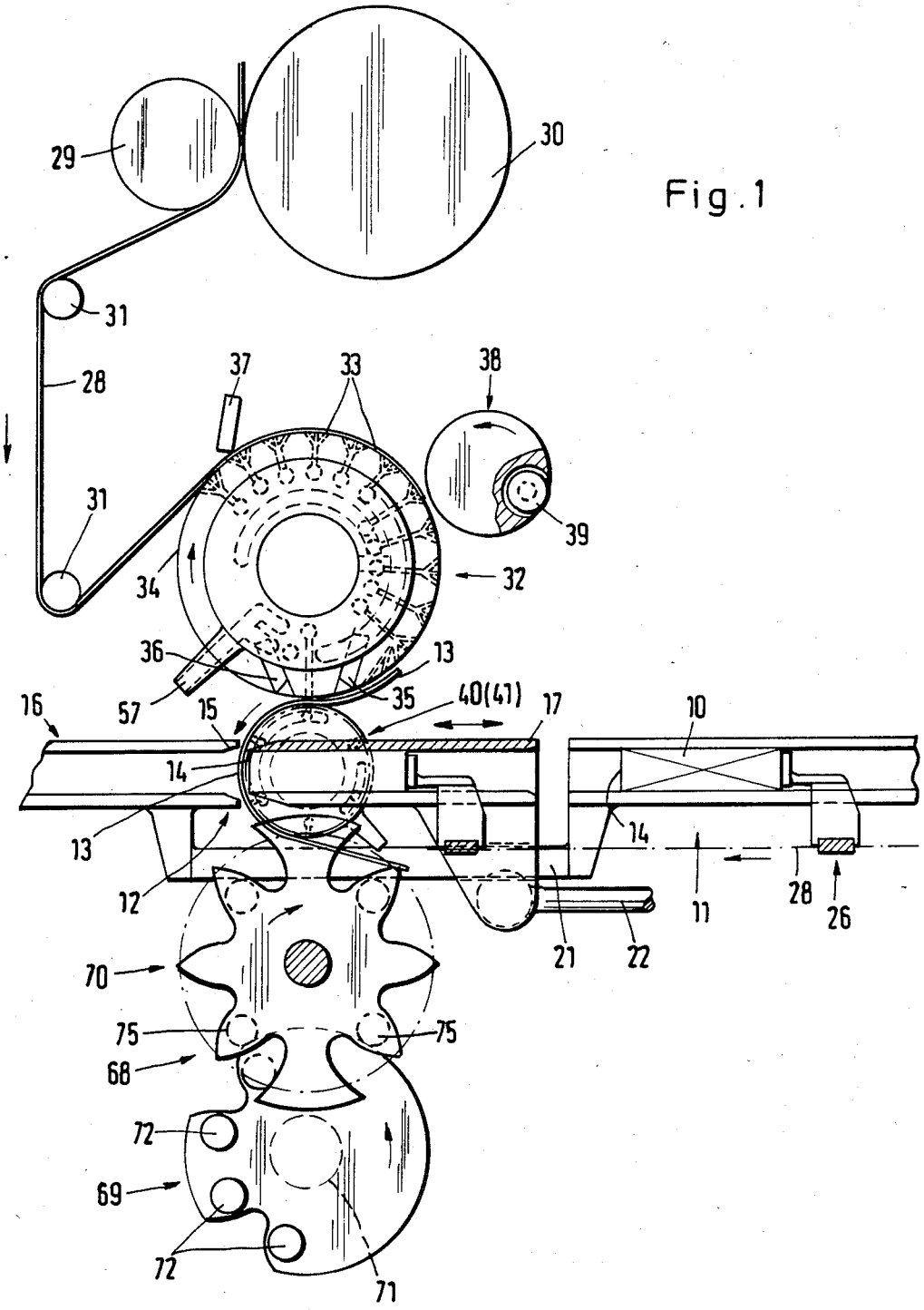

The invention relates to an apparatus for wrapping articles in a blank, especially groups of cigarettes in a tin foil blank, whih is severed from a sheet of material in the region of the first endless conveyor (suction and cutting cylinder) and conveyed further to a second endless conveyor (suction disks), whilst at the same time the blank is retained by the second endless conveyor, at least in two lateral edge regions, in a plane transverse to the direction of transport of the article and, being pulled off from the said second endless conveyor, can be wrapped round the article in a U-shaped manner.

An apparatus of this type is the subject of German Offenlegungsschrift No. 2,906,204. A sheet of material consisting of tin foil or the like is fed to a suction and cutting cylinder rotating continuously at a uniform speed. On the periphery of the latter, the individual blanks are severed from the sheet of material by severing knives and fed to the suction disks functioning as a subsequent second endless conveyor. The cigarette groups to be wrapped are conveyed through between the suction disks mounted in the same axis and at a distance from one another, a blank being wrapped in a U-shaped manner round the end face, located at the front in the direction of transport, of each particular cigarette group. In this known apparatus, to protect the cigarettes the cigarette group is introduced into a mouthpiece which terminates flush with the cigarette group on the side located at the front in the direction of transport and which absorbs mechanical stresses during the U-shaped wrapping operation. The suction disks are likewise driven to rotate continuously and uniformly in synchronism with the suction and cutting cylinder.

The object on which the invention is based is to develop further and improve apparatus of the above-mentioned type or of a similar design, in particular to increase their efficiency, without damaging sensitive packaged articles, especially cigarettes, as a result of relatively severe mechanical stress.

To achieve this object, the apparatus according to the invention is defined in that the suction and cutting cylinder (first endless conveyor) is driven to rotate continuously and the suction disks (second endless conveyor) are driven intermittently, in such a way that, during a standstill phase of the suction disks, the blank can be pulled off from the suction disks by the article (cigarette group).

Because of the momentary standstill of the suction disks, it is possible to align the blank more accurately in terms of its position in relation to the article (cigarette group). Furthermore, it is consequently possible to achieve higher outputs of the packaging machine, because the distances between the articles (cigarette groups) during feeding are made shorter. The cycle times thereby become shorter, without the cigarette groups being conveyed at a higher speed and therefore being exposed to increased stresses. Surprisingly, the momentary standstill of the suction disks makes it possible to obtain the shorter cycle times, because during movement, in particular during the feeding of the blank, higher speeds can be adopted. However, owing to the standstill phase, these do not result in an inaccurate relative position of the blank.

According to a further proposal of the invention, the first endless conveyor, that is to say the suction and cutting cylinder, is driven at a relatively high rotational speed. During the transfer of a blank to the suction disks, the peripheral speed of the latter corresponds to that of the suction and cutting cylinder. After that, in particular when the next blank is conveyed into the transfer region, the suction disks rotate at an appropriately higher rotational speed.

The sheet of material (tin foil) is fed continuously to the suction and cutting cylinder at a constant speed. The always uniform conveying speed is markedly lower than the maximum rotational speed (peripheral speed) of the suction and cutting cylinder. The front part of the sheet of material resting against the shell of the latter is conveyed further with slip, that is to say with a relative movement in relation to the suction and cutting cylinder. As soon as the blank is severed from the sheet of material on the suction and cutting cylinder, it is transported further at the higher speed of the said cylinder. The relative slipping movement of the sheet of material is made possible by suction bores which serve for fixing the latter appropriately on the shell of the suction and cutting turret.

Accordingly, a particular feature of the invention is that the sheet of material is fed at a constant speed, the severed blank is then accelerated considerably by the first endless conveyor and transferred to the revolving suction disks at a synchronised conveying speed, and the latter are brought to a momentary standstill. This cycle of movement makes it possible to achieve a noticeably higher output.

Further features of the invention relate to the design of the endless conveyors and severing devices.

Figure 2:
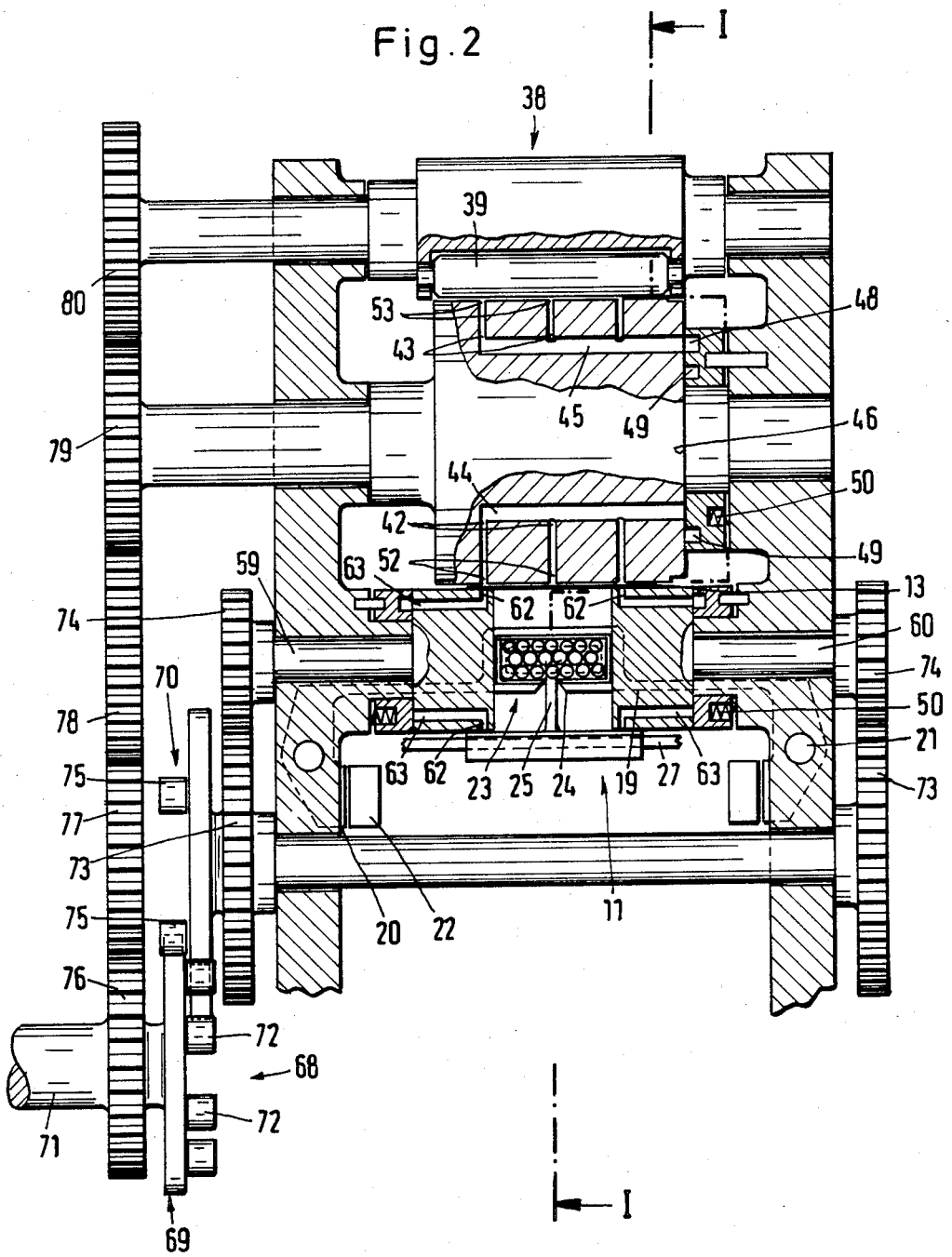
Figure 3:
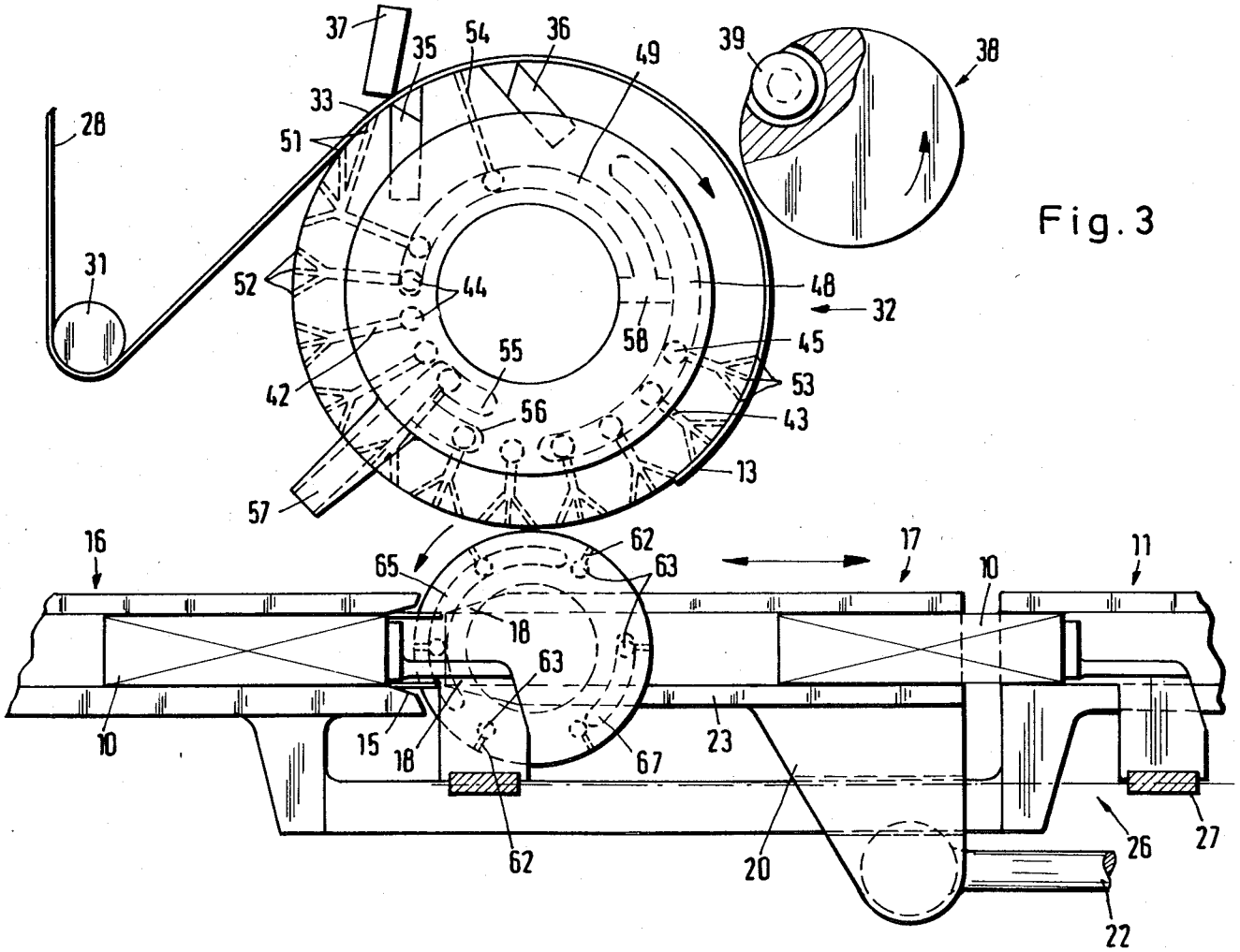
Figure 4:
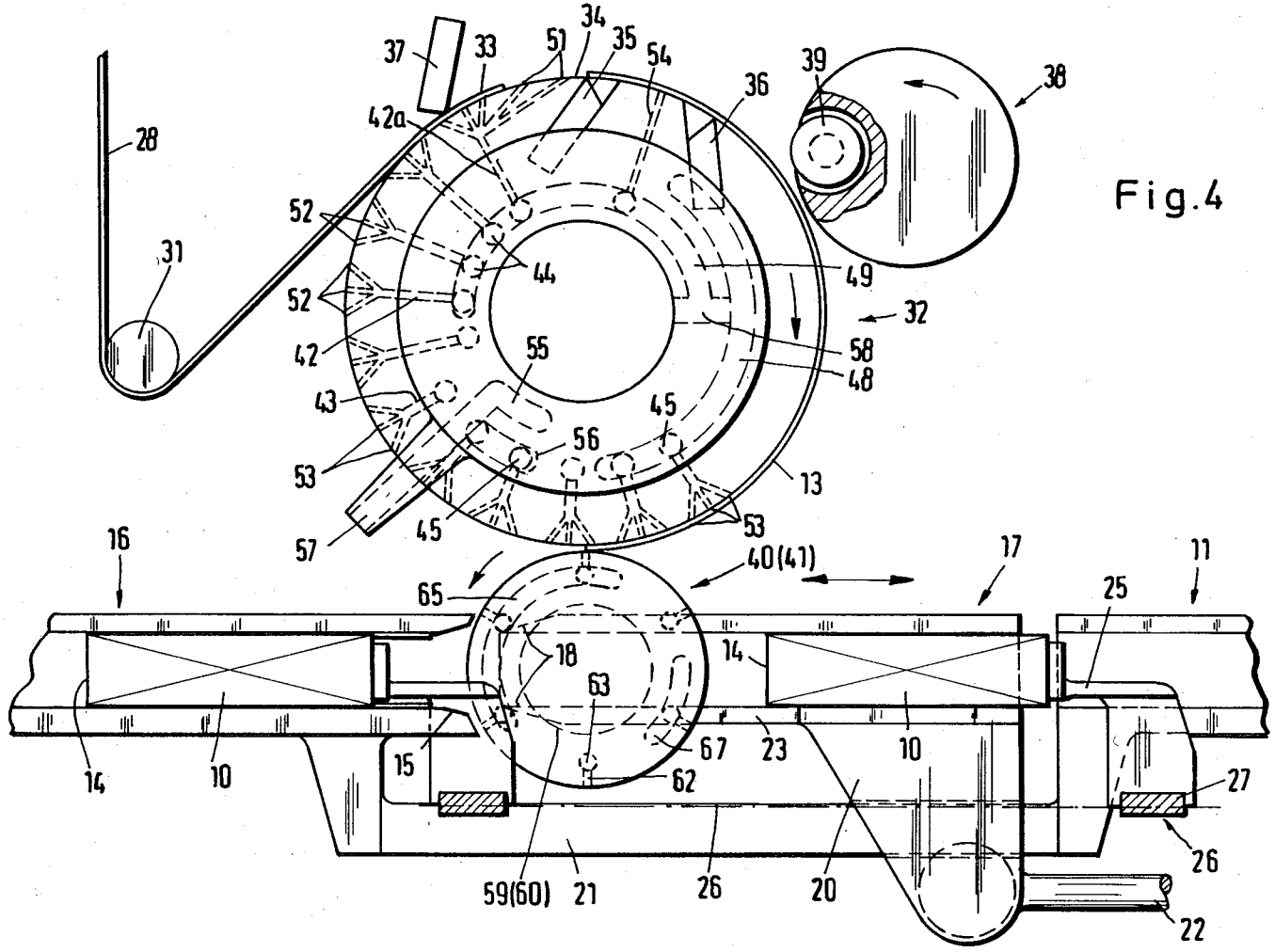
Figure 5:
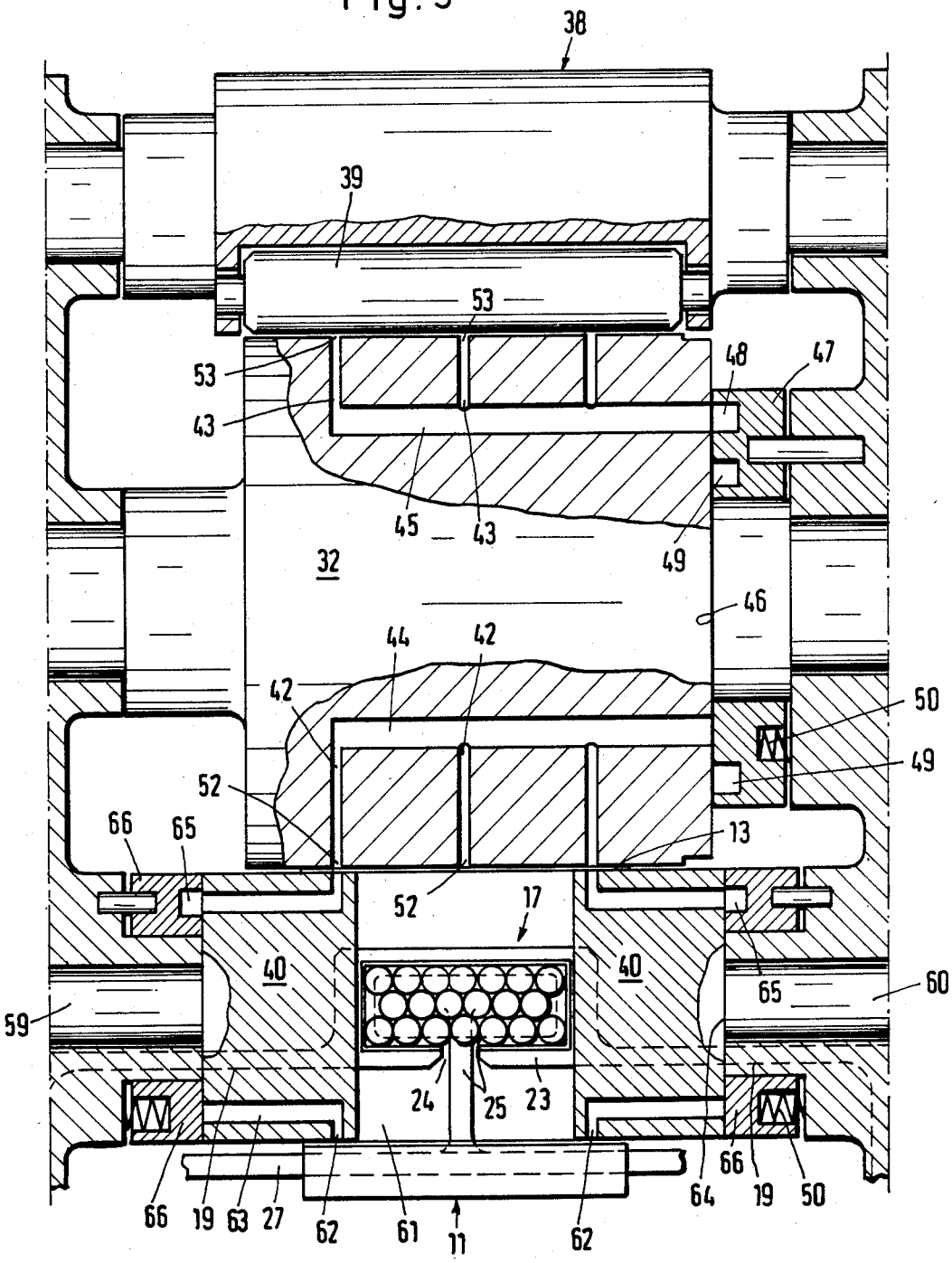
Figure 6:
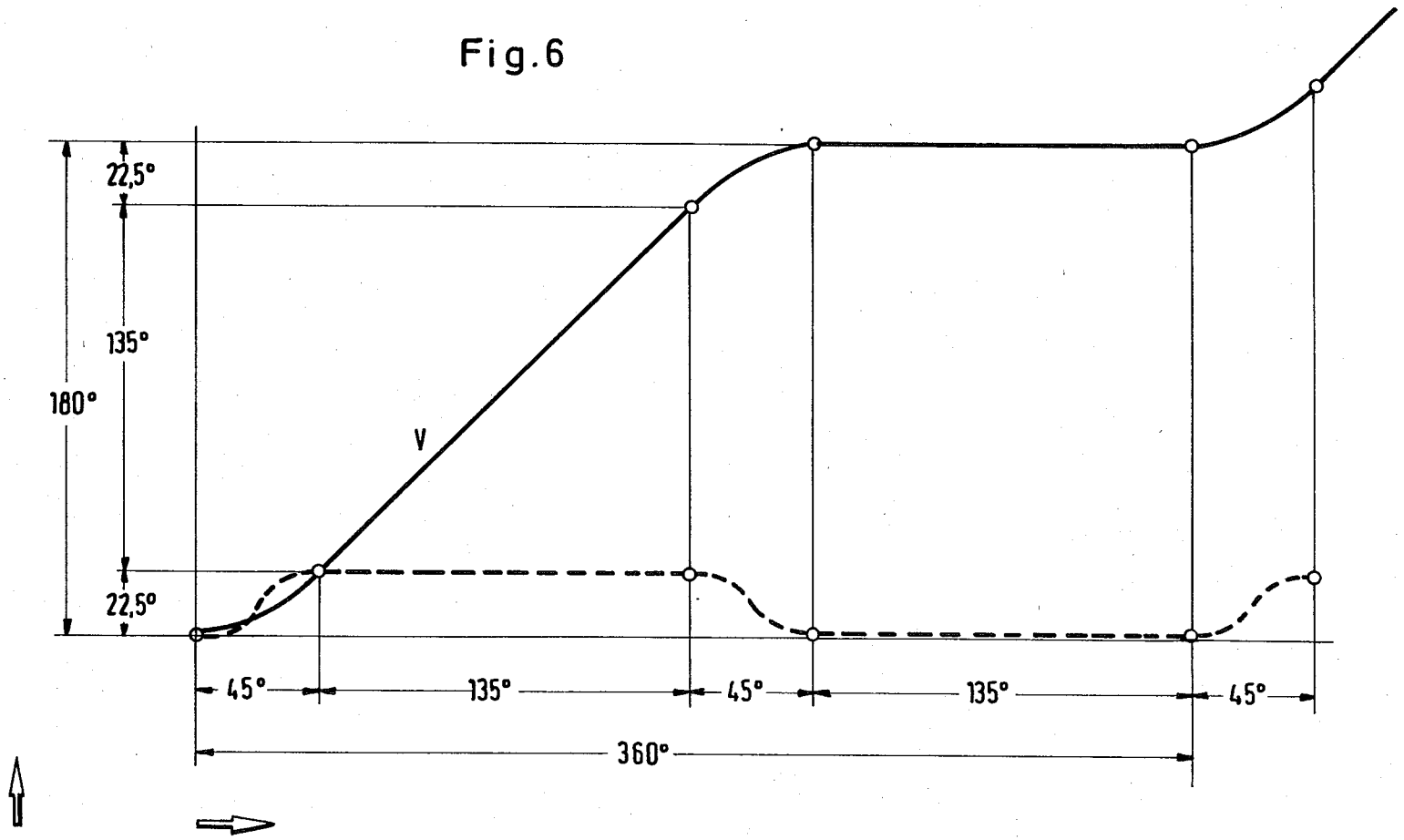

An exemplary embodiment of the invention is explained in more detail below with reference to the drawings in which:

FIG. 1 shows the essential part of the apparatus in a diagrammatic side view, partially in longitudinal section, FIG. 2 shows a cross-section through the apparatus according to FIG. 1, FIG. 3 shows a view corresponding to FIG. 1, without the stepping gear, with parts of the apparatus in changed relative positions, FIG. 4 shows a representation corresponding to FIG. 3, with the relative position changed again, FIG. 5 shows a cut-out of FIG. 2 on an enlarged scale, FIG. 6 shows a graph of the movement characteristic within a work cycle.

The apparatus illustrated in the drawings is part of a packaging machine for cuboid articles, especially cigarette groups 10. These are conveyed in succession and at a distance from one another along a straight (linear) pack track 11. At the same time, the cigarettes of the cigarette group 10 are oriented in the conveying direction. In the region of a wrapping station 12, a blank 13, consisting especially of tin foil, held ready transversely to the conveying direction, is folded round the cigarette group 10 in a U-shaped manner, specifically because the blank 13 is carried along by an end face 14, located at the front in the direction of movement, of the cigarette group 10. The end face 14 grasps the blank 13 in a predetermined region, conventionally in the middle. Because the cigarette group 10 is conveyed further, it is wrapped in a U-shaped manner because of being pushed, together with the blank 13, into a mouthpiece-like orifice 15 of a further-conveying track 16.

To protect the cigarette group 10 against undesirable mechanical stress when the blank 13 is received, the cigarette group 10 is conveyed through a mouthpiece 17 driven to and fro. At the moment when the blank 13 is received, a sharply tapering front edge 18 of the mouthpiece 17 is essentially flush with the end face 14 of the cigarette group 10. Thus, the upper, lower and lateral edges of the latter are protected by the mouthpiece 17 designed with an essentially closed cross-section.

As is evident particularly from FIG. 5, the mouthpiece 17 is supported laterally outside the path of movement of the cigarette group 10 by means of transversely directed supporting legs 19 and a sliding body 20, specifically so as to be movable too and fro on lateral slide rods 21. The mouthpiece 17 is driven to and fro in synchronism by means of connecting rods 22.

A continuous slit 24 is formed in the conveying direction on the underside of the mouthpiece 17, in particular in a bottom wall 23 of the latter. This slit allows the passage of a conveying member, in particular an engagement device 25 of a chain conveyor 26 for transporting the cigarette groups 10 in the region of the pack track 11. The engagement devices 25, each grasping a cigarette group 10 on its rear side, are attached to transverse rods 27 which are themselves connected to lateral chains 28. Otherwise, the design and mode of operation of the mouthpiece 17 and of the chain conveyor 26 correspond to the details of the apparatus according to German Offenlegungsschrift No. 2,906,204.

The blanks 13 are severed from a continuous sheet of material 28 consisting, for example, of tin foil. The sheet of material 28 is conveyed by means of a pair of claw rollers 29, 30 which are driven at a constant speed. Accordingly, the conveying speed of the sheet of material 28 is likewise constant, specifically so that a portion of the sheet of material 28 corresponding exactly to the length of the blank 13 is available within a work cycle.

The sheet of material 28 is fed to a suction and cutting cylinder 32 via deflecting rollers 31. A front part 33 of the sheet of material 28 runs approximately tangentially into the peripheral surface 34 of the suction and cutting cylinder 32. Further transport is now taken over by the rotating suction and cutting cylinder 32.

The suction and cutting cylinder 32 is equipped with two severing knives 35 and 36. A cutting edge of the severing knife 35 extends in the plane of the peripheral surface 34. This severing knife 35 interacts with a fixed counter-knife 37, the cutting edge of which is arranged at such a short distance from the peripheral surface 34 of the suction and cutting cylinder 32 that, during the relative movement between the severing knife 35 and the counter-knife 37, the sheet of material 28 is severed and the blank 13 is thus produced.

The counter-knife 37 is arranged in relation to the place where the sheet of material 28 comes onto the peripheral surface 34, in such a way that, after the blank 13 has been severed, a front part 33 sufficient for continuing the transport of a sheet of material 28 rests against the peripheral surface 34.

During further transport by the suction and cutting cylinder 32, the severed blank 13 is provided, in the region of a knife roller 38, with a further severing cut or a perforation cut by means of the second severing knife 36 having its cutting edge set back from the peripheral surface 34, for example in order to define a flap in the case of a tin foil wrapping of the cigarette group 10. The knife roller 38 driven to rotate is provided with a knife roll 39 which is mounted so as to be freely rotatable and which projects beyond the peripheral surface of the knife roller 38. This knife roller interacts with the cutting edge of the severing knife 36, in such a way that the perforation cut can be made within the blank 13.

Further along its path, in particular in the lower region of the suction and cutting cylinder 32, the blank 13 is transferred to suction disks 40, 41 functioning as a second endless conveyor. These convey the blank 13 into the above-described relative position in relation to the pack track 11 for the transfer of the blank 13 to the cigarette group 10.

The sheet of material 28 or the blank 13 is retained on the peripheral surface 34 of the suction and cutting cylinder 32 as a result of suction. For this purpose, suction bores open onto the peripheral surface 34, and several of these are connected in each case via an approximately radially directed connecting bore 42, 43 to collecting bores 44, 45 guided axially or parallel to the axis. The latter open out in the region of a lateral end face 46 of the cutting and suction cylinder 32. Matching the mouths of the collecting bores 44, 45, distributor grooves 48 and 49, each in the shape of an arc of a circle, are formed in a distributor disk 47 which is fixed, that is to say does not rotate. These distributor grooves each extend over a part periphery of the suction and cutting cylinder 32 according to the suction bores subjected to different local stresses. The distributor grooves 48, 49 are connected to a central vacuum source (not shown). The distributor disk 47 is pressed by means of axially acting compression springs 50 against the end face 46 of the suction and cutting cylinder 32.

Because of the different functions, the suction bores are distributed irregularly over the peripheral surface 34 of the suction and cutting cylinder 32. The connecting bore 42*a* is assigned to a larger number of suction bores 51 which open out in a distributed arrangement. The object of this multiplicity of suction bores 51 is, in an appropriate relative position of the suction and cutting cylinder 32, to fix the front part 33 of the sheet of material 28 on the peripheral surface 34 sufficiently, after the blank 13 has been severed, in order to guarantee further transport. At this particular time, the connecting bore 42*a* is located, together with the associated collecting bore 44, in the region of the distributor groove 49.

The suction bores 52 which follow counter to the direction of rotation of the suction and cutting cylinder 32 are likewise arranged so that the part of the sheet of material 28 conveyed on the peripheral surface 34 is fixedly reliably.

The group of connecting bores 43 assigned to the distributor groove 43 then follows in the peripheral direction counter to the direction of rotation. The object of the suction bores 53 belonging to these is likewise to retain the sheet of material 28 on the peripheral surface 34 (FIG. 1), when the suction bores 51 and 52 have been moved out of the region of the latter. The suction bores 53 are then followed by a peripheral portion of the suction and cutting cylinder 32 which is free of suction bores. The blank 13 extends in this region after it has been severed from the sheet of material 28. The phase of the severing cut is shown in FIG. 3. According to this, the blank 13 is retained in a region located at the front of the conveying direction by the suction bores 53 and in the rear region by an individual radially directed suction bore 54 assigned to the distributor groove 49 via a collecting bore 44. Several of the above-described suction bores are in each case arranged next to one another and distributed in the axial direction of the suction and cutting cylinder (FIG. 2).

As is evident from FIG. 4, only a few suction bores 53 are connected operatively to the front region of the blank 13 when the latter is transferred to the suction disks 40, 41. After the blank 13 has been grasped by these, there follows a peripheral region of the suction and cutting cylinder which is free of suction bores.

In the region where the blank 13 is transferred directly onto the periphery of the suction disks 40, 41, the collecting bores 45 assigned to the suction bores 53 leave the region of the distributor groove 48. The suction bores 53 are thereby vented, and the retaining force exerted on the blank 13 is consequently cancelled.

During the further movement of the suction and cutting cylinder 32, the collecting bores 45 and the collecting bores 44 pass into the region of blowing grooves 55 and 56 which are formed in the distributor disk 47 in the manner of the distributor grooves 48 and 49. The suction grooves 55 and 56 are connected to a compressed-air source via a compressed-air connection 57. The entire system of grooves and bores is cleared of particles of dust and tobacco in this region by means of compressed air.

Because of their different designs (diameters) and their positions within the fixed distributor disk 47, the distributor grooves 48 and 49 make it possible to determine accurately the retaining force for the sheet of material 28 and the blank 13. The distributor grooves 48 and 49 partially overlapping one another are combined into a unitary suction-channel system by means of a radial connecting groove 58.

The suction disks 40 and 41 are designed in a similar way. As is evident particularly from FIG. 5, the suction disks 40 and 41 are each attached to a shaft end 59 and 60, in such a way that a transport space 61 approximately of the width of the cigarette group 10 remains between them. The latter is conveyed through between the suction disks 40, 41, and the blank 13 held ready on the periphery of the suction disks 40, 41 is pulled off and carried along.

For this purpose, the suction disks 40, 41 of identical design are likewise provided with suction bores 62 which open onto the peripheral surfaces and which are connected to axis-parallel collecting bores 63. These in turn open, in the region of lateral end faces 64, into a distributor groove 65 of a distributor disk 66. A blowing groove 67 is also formed in the latter.

The suction bores 62 arranged along the periphery of the suction disks 40, 41 approximately at equal distances from one another interact with the distributor groove 65 extending along a part periphery, in such a way that a blank 13 is fixed sufficiently by means of suction air via the suction bores 62 in the region where a blank 13 is received and conveyed further into the position of transfer to the cigarette group 10. As can be seen, the distributor groove 65 ends underneath the transport plane of the cigarette group 10, so that a region of the blank 13 located at the front in the conveying direction is no longer retained. As a result, it becomes easier to pull the blank 13 off from the section disks 40, 41 with a slipping action. The rear region of the blank 13 still assigned to the peripheral surface 34 of the suction and cutting cylinder is also free of suction air (FIG. 1) as a result of the design of the suction-channel system in the suction and cutting cylinder 32.

The drive of the conveying member described is of particular importance. Whilst the constant uniform conveying speed V1 of the sheet of material 28 is maintained, the suction and cutting cylinder 32 rotates at a considerably higher peripheral speed V2. This produces a relative movement between the sheet of material 28 and the suction and cutting cylinder 32. With the sheet of material 28 being maintained up against the peripheral surface 34, a slipping movement takes place. After the blank 13 has been severed, it is conveyed at the (higher) speed V2 of the suction and cutting cylinder 32, because it is fixed to the peripheral surface 34, and at the same time moves increasingly further away from the front part 33 of the sheet of material 28. Because of this higher acceleration of the blank, rapid re-transfer to the suction disks 40, 41 becomes possible. During this phase, the peripheral speed of the suction and cutting cylinder 32 corresponds to that of the suction disks 40, 41. For example, the conveying speed V1 of the sheet of material can be approximately 150 cm/sec, whilst the speed V2 amounts to approximately 300 cm/sec.

The suction disks 40 and 41 are driven discontinuously, that is to say intermittently. For this purpose, a special, but basically known stepping gear 68 is provided. This consists of a driver 69 and a star wheel 70. The former is driven continuously via a central shaft 71. At the same time, sprockets 72 of the driver 69 penetrate in succession into recesses of the star wheel 70. One peripheral region of the driver 69 is not fitted with sprockets 72 of this type. During this phase, no rotary movement is transmitted in spite of the rotation of the driver 69. This results in a non-uniform rotation of the star wheel 70. The movement of the latter is transmitted to the suction disks 40, 41 via gear wheels 73 and 74. Furthermore, the standstill phase of the star wheel 70 is fixed by supporting rollers 75 on the star wheel 70, which rest periodically against the outer periphery of the driver 69.

FIG. 6 illustrates in a graph the movement characteristic of the driver in relation to that of the star wheel. It emerges from this that a rotary movement takes place over a path of 180° of the star wheel, whilst the star wheel and consequently the suction disks 40, 41 are at a standstill over an identical angle of rotation or the same period of time. The unbroken line of the graph shows the time/path relationship between the driver and star wheel, whilst the broken line represents the speed of the star wheel, again in relation to the path of the driver. The drive by the central shaft 71 is transmitted via gear wheels 76, 77, 78, 79 and 80 both to the suction and cutting cylinder 32 and to the knife roller 38, with an appropriate step-up or step-down ratio.

In the apparatus described, the work cycle is shorter than usual because of the shorter distances between the cigarette groups 10 supplied, this being the result of shorter distances between the engagement devices 25. In spite of this, it is possible to feed the blanks to the articles (cigarette groups) more accurately because of the periodically considerably higher conveying speeds of the blanks and, on the other hand, because of the standstill phase of the latter.

I claim:

1. An apparatus for wrapping articles conveyed in a first transport direction in a blank of material which is severed from a sheet of said material comprising:

first endless conveyor means adapted to hold said sheet material by suction and to cut said sheet material into desired blank portions;

second endless conveyor means adapted to transfer said cut sheet material from said first endless conveyor means and to retain said blank portion on the surface thereof in at least two lateral edge regions and to rotate said blank to a position which is transverse to the direction of transport of the article; and means for pulling said blank from said second endless conveyor means and wrapping said blank around the article in a U-shaped manner, the improvement wherein:

said first endless conveyor means is driven to rotate continuously and said second endless conveyor means is driven intermittently between a rotational phase and a standstill phase, whereby during said standstill phase said means for pulling the blank operates to remove the blank from said second endless conveyor.

2. An apparatus as claimed in claim 1 wherein the first endless conveyor means is driven at a substantially uniform peripheral speed and the peripheral speed of said second conveyor means during the rotational phase at the time said blank is transferred from said first conveyor means to the second conveyor means is substantially identical to the peripheral speed of said first endless conveyor.

3. An apparatus as claimed in claim 1 or 2, wherein the sheet of material can be fed to the first endless conveyor means at a first constant conveying speed, and the severed blank can be accelerated by the first endless conveyor means to a second speed which is a peripheral speed higher than said first speed.

4. An apparatus as claimed in claim 3, wherein said peripheral speed of the first conveyor means is approximately twice as high as the conveying speed of the sheet of material.

5. An apparatus as claimed in claim 1, wherein a front part of the sheet of material, resting against a peripheral surface of the first conveying means after the blank has been severed, is retained, with slip, against the peripheral surface of said means as a result of suction, while continuing to be conveyed at said sheet conveying speed.

6. An apparatus as claimed in claim 1 wherein the first conveying means is provided along the peripheral surface with irregularly distributed suction bores, and preferably, a larger number of suction bores are arranged in one region of the peripheral surface, to grasp the front part of the sheet of material.

7. An apparatus as claimed in claim 6 wherein the severed blank is grasped by said suction bores on the peripheral surface of the first conveying means essentially only in a front and rear region.

8. An apparatus as claimed in claim 6 wherein said several suction bores are connected to a central vacuum source by means of essentially radially directed connecting bores and axially directed collecting bores intended for the latter and communicating with lateral fixed distributor grooves, such distributor grooves being assigned to groups of suction bores in different relative positions.

9. An apparatus as claimed in claim 8 wherein several distributor grooves of different diameters are in a concentric arrangement and are connected to one another by means of connecting grooves.

10. An apparatus as claimed in claim 1 wherein said second conveying means is driven from a central shaft by a stepping gear, said stepping gear consisting of a continuously rotating driver and a star wheel rotating intermittently according to the rotation of said second conveying means in such a way that said rotary phase and said standstill phase are approximately of equal duration.

11. An apparatus as claimed in claim 10 wherein the first conveying means comprises a knife roller means driven by the said common central shaft via gear wheels.

* * * * *